US005357934A

United States Patent [19]

Iida et al.

[11] Patent Number: 5,357,934

[45] Date of Patent: Oct. 25, 1994

[54] APPARATUS FOR CONTROLLING PRESSURE WITHIN FUEL TANK

[75] Inventors: Hisashi Iida, Aichi; Yasuo Tagawa, Kariya, both of Japan

[73] Assignee: Nippondenso Co., Ltd., Kariya, Japan

[21] Appl. No.: 136,128

[22] Filed: Oct. 15, 1993

[30] Foreign Application Priority Data

Oct. 16, 1992 [JP] Japan ..... 4-278496

[51] Int. Cl.[5] ..... F02M 33/02

[52] U.S. Cl. ..... 123/520; 123/198 D

[58] Field of Search ..... 123/516, 518, 519, 520, 123/521, 198 D

[56] References Cited

U.S. PATENT DOCUMENTS

| | | | |
|---|---|---|---|
| 3,518,977 | 7/1970 | Smith | 123/520 |
| 3,690,307 | 9/1972 | O'Neill | 123/520 |
| 3,752,134 | 8/1973 | Hollis | 123/520 |
| 3,935,850 | 2/1976 | King | 123/520 |
| 4,153,025 | 5/1979 | Thornburgh | 123/520 |
| 4,702,216 | 10/1987 | Haruta | 123/520 |
| 5,165,379 | 11/1992 | Thompson | 123/520 |
| 5,174,265 | 12/1992 | Sekine | 123/520 |
| 5,193,511 | 3/1993 | Fujino | 123/520 |

FOREIGN PATENT DOCUMENTS 56-90923 of 1981 Japan .

OTHER PUBLICATIONS

"Evaporative Emission Control System (EECS)" Deville/Fleetwood Service Information Manual 1989—(Driveability And Emission Controls 6E-C3-1).

*Primary Examiner*—Carl S. Miller

*Attorney, Agent, or Firm*—Cushman, Darby & Cushman

[57] ABSTRACT

An apparatus for controlling pressures within a fuel tank is provided in a purge pipe connected between the fuel tank and a canister. In an operating condition of an engine, a diaphragm in a control valve provided in a purge pipe between the fuel tank and the canister is moved upward by an intake negative pressure to decrease a set load of a spring, and in a stopped condition of the engine, the diaphragm moves downward to increase the set load of the spring. As a result, in the operating condition of the engine, a valve member is opened when a pressure within the fuel tank exceeds a lower predetermined level. In the stopped condition of the engine, the valve member is opened when a pressure within the fuel tank exceeds a higher predetermined level. Therefore, even when a leakage accident occurs in the operating condition of the engine, evaporated fuel is prevented as much as possible from being discharged in a large amount into the atmosphere. In the stopped condition of the engine, an amount of evaporated fuel produced within the fuel tank can be reduced, so that a canister can be of a compact size.

2 Claims, 3 Drawing Sheets

CONTROL CIRCUIT
THROTTLE OPENING SIGNAL
ENGINE SPEED SIGNAL
INTAKE AIR AMOUNT SIGNAL
COOLING WATER TEMPERATURE SIGNAL
INTAKE AIR TEMPERATURE SIGNAL
INTAKE AIR
1
2
3
4
5
6
7
8
9
10
35
36
37
38
40
41
42
43
44
100

APPARATUS FOR CONTROLLING PRESSURE WITHIN FUEL TANK

BACKGROUND OF THE INVENTION

This invention relates to an apparatus for controlling pressures within a fuel tank in accordance with an operating condition of an engine.

For example, Japanese Utility Model Unexamined Publication No. 56-90923 discloses a conventional construction in which a check valve is provided in a pipe connected between a fuel tank and a canister. When evaporated fuel is produced within the fuel tank and the pressure within the tank reaches a predetermined level, the check valve is opened to supply the evaporated fuel to the canister.

In this conventional construction, however, the pressure in the fuel tank at which the fuel tank is caused to communicate with the canister is set to a predetermined level, and therefore in the case where this predetermined pressure is high, a large amount of evaporated fuel may be discharged to the ambient atmosphere if a leakage accident occurs between the fuel tank and the check valve. In contrast, where the predetermined pressure is low, an amount of evaporated fuel supplied to the canister increases, which results in a problem that the canister must be increased in size.

Therefore, there has been proposed a technique in which there is set a predetermined pressure of a fuel tank, at which the fuel tank is caused to communicate with a canister, by an intake negative pressure when an engine is in a stopped condition, and when the pressure within the fuel tank exceeds this predetermined level, evaporated fuel is supplied to the canister. In an operating condition of the engine, the fuel tank is always in communication with the canister to supply the evaporated fuel to the canister.

In this prior art technique, however, since the fuel tank is always in communication with the canister in the operating condition of the engine, an amount of the evaporated fuel from the fuel tank is increased by the negative pressure from the engine. The evaporated fuel is not discharged to the ambient atmosphere, and therefore when a large amount of the evaporated fuel is supplied to the engine, the control of the air-fuel ratio is adversely affected. To overcome this problem, it is necessary to use the type of canister which positively adsorbs an increased amount of evaporated fuel; however, this increases the size of the canister.

SUMMARY OF THE INVENTION

With the above problems of the prior art in view, it is an object of this invention to provide a fuel tank pressure control apparatus which enables a small-size construction of a canister, and reduces the amount of leakage of evaporated fuel into the ambient atmosphere in the even of a leakage accident.

According to the present invention, there is provided an apparatus for controlling a pressure within a fuel tank, comprising:

- detection means for determining whether an engine is in an operating condition or in a stopped condition;
- means for adsorbing evaporated fuel produced within the fuel tank; and
- control means for adjusting pressures within the fuel tank, at which the fuel tank is caused to communicate with the evaporated fuel adsorbing means, to a first predetermined level when the detection means determines that the engine is in the operating condition, and to a second predetermined level when the detection means determines that the engine is in the stopped condition, said second predetermined level being higher than said first predetermined level.

In this fuel tank pressure control apparatus, the pressure within the fuel tank, at which the fuel tank is caused to communicate with the evaporated fuel adsorbing means is adjusted by the control means to the first predetermined level when the detection means determines that the engine is in the operating condition, and also, to the second predetermined level higher than the first predetermined level when the detection means determines that the engine is in the stopped condition.

The first predetermined pressure is lower than the second predetermined pressure, and therefore even when a leakage accident occurs in the operating condition of the engine, evaporated fuel is prevented as much as possible from being discharged in a large amount to the atmosphere. The fuel tank becomes communicated with the canister when the first predetermined pressure is reached, and therefore at pressures lower than this first predetermined level, the evaporated fuel in the fuel tank is prevented from flowing into the canister.

Since the second predetermined pressure is higher than the first predetermined pressure, an amount of evaporated fuel produced in the fuel tank in the stopped condition of the engine is reduced. Therefore, the evaporated fuel is prevented from being excessively supplied to the canister.

DESCRIPTION OF THE PREFERRED EMBODIMENTS

An apparatus for controlling pressures within a fuel tank, according to the present invention, will now be described.

Figure 1:
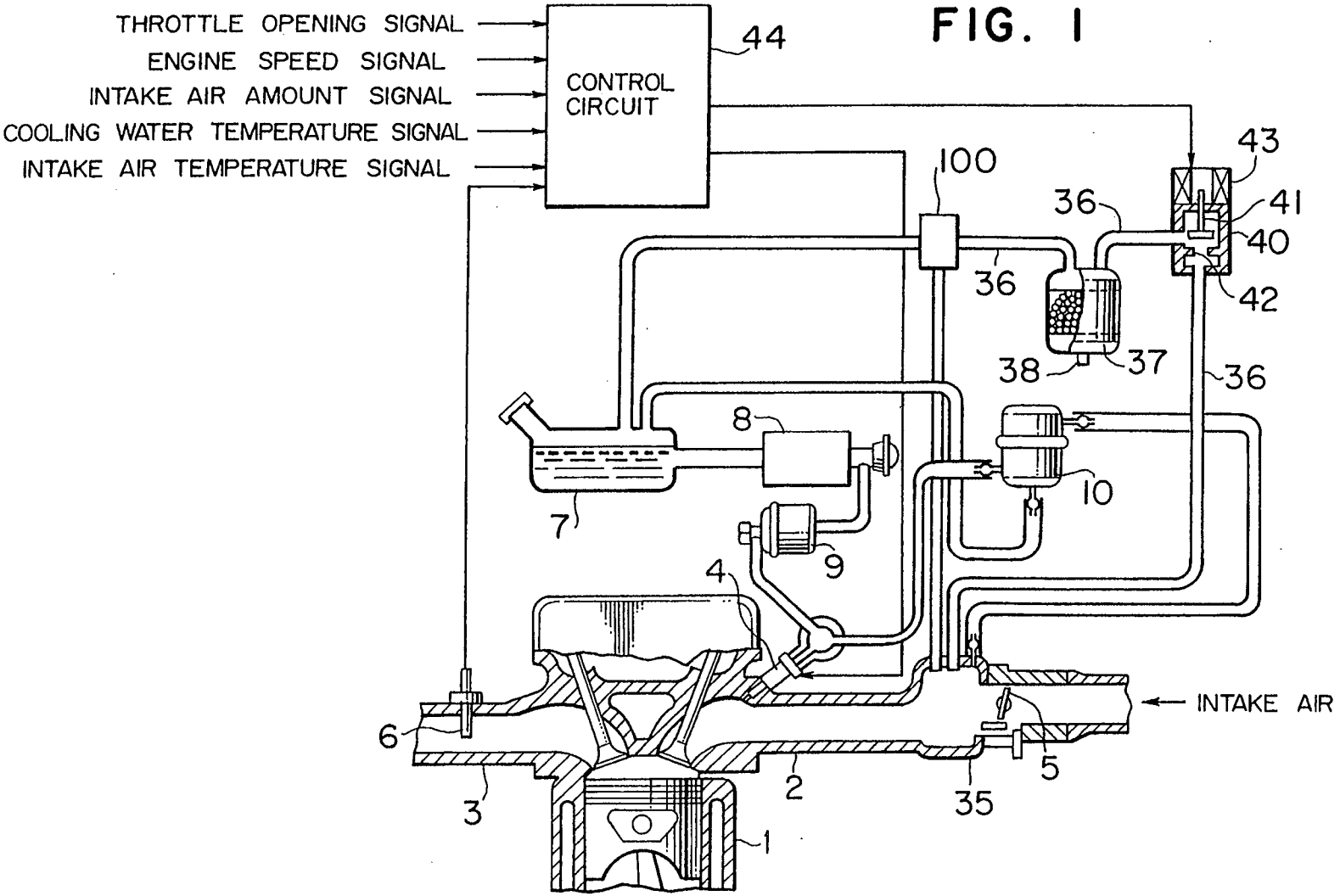
FIG. 1 is a schematic view of an internal combustion engine provided with a fuel tank pressure control apparatus of the present invention.

FIG. 1 schematically shows an internal combustion engine provided with the fuel tank pressure control apparatus of the present invention. An intake pipe 2 and an exhaust pipe 3 are connected to the engine 1. A fuel injection valve 4 in the form of a solenoid valve is provided in each cylinder in the intake pipe 2, and a throttle vale 5 is provided in the intake pipe 2. An $0_2$ sensor 6 is provided in the exhaust pipe 3, and outputs an electrical signal representative of an oxygen concentration in an exhaust gas.

In a fuel supply system for supplying fuel to each fuel injection valve 4, fuel held air-tight in a fuel tank 7 is fed under pressure by a fuel pump 8 to each fuel injection valve 4 via a fuel filter 9, and the pressure of the fuel to be supplied to the fuel injection valve 4 is adjusted to a predetermined level by a control valve 10.

A purge pipe 36 is connected to the fuel tank 7, and is communicated with a surge tank 35 of the intake system. A canister 37 serving as an evaporated fuel adsorption means is provided in the purge pipe 36. The canister 37 contains an adsorbent in the form of activated charcoal, and adsorbs evaporated fuel produced within the fuel tank 7. The canister 37 has an atmosphere-opening port 38 for drawing the air.

A purge solenoid valve (hereinafter referred to as "purge valve") 40 is provided in the purge pipe 36 connected between the canister 37 and the surge tank 35. A valve member 41 of the purge valve 40 is normally urged by a spring (not shown) in a direction to open a valve seat 42. When a coil 43 is excited, the valve member 41 closes the valve seat 42. Thus, upon deenergization of the purge valve 40, the purge pipe 36 is opened, and upon energization of the purge valve 40, the purge pipe 36 is closed.

A control valve 100 for controlling pressures within the fuel tank 7 is provided in the purge pipe 36 connected between the canister 37 and the fuel tank 7. The construction of this control valve 100 will be described later.

A throttle opening signal, an engine speed signal, an intake air amount signal, a cooling water temperature signal, and an intake air temperature signal are inputted from respective sensors (not shown) to a control circuit 44 incorporating a microcomputer. The control circuit 44 determines a basic injection time in accordance with the engine speed signal and the intake air amount signal among these signals, and amends this basic injection time in accordance with the other signals and the signal from the $O_2$ sensor, thus computing a final injection time. Then, in accordance with this final injection time, fuel is injected from the fuel injection valve 4 at a predetermined timing. The control circuit 44 is also connected to the purge valve 40 to control the opening and closing of this valve.

Figure 2:
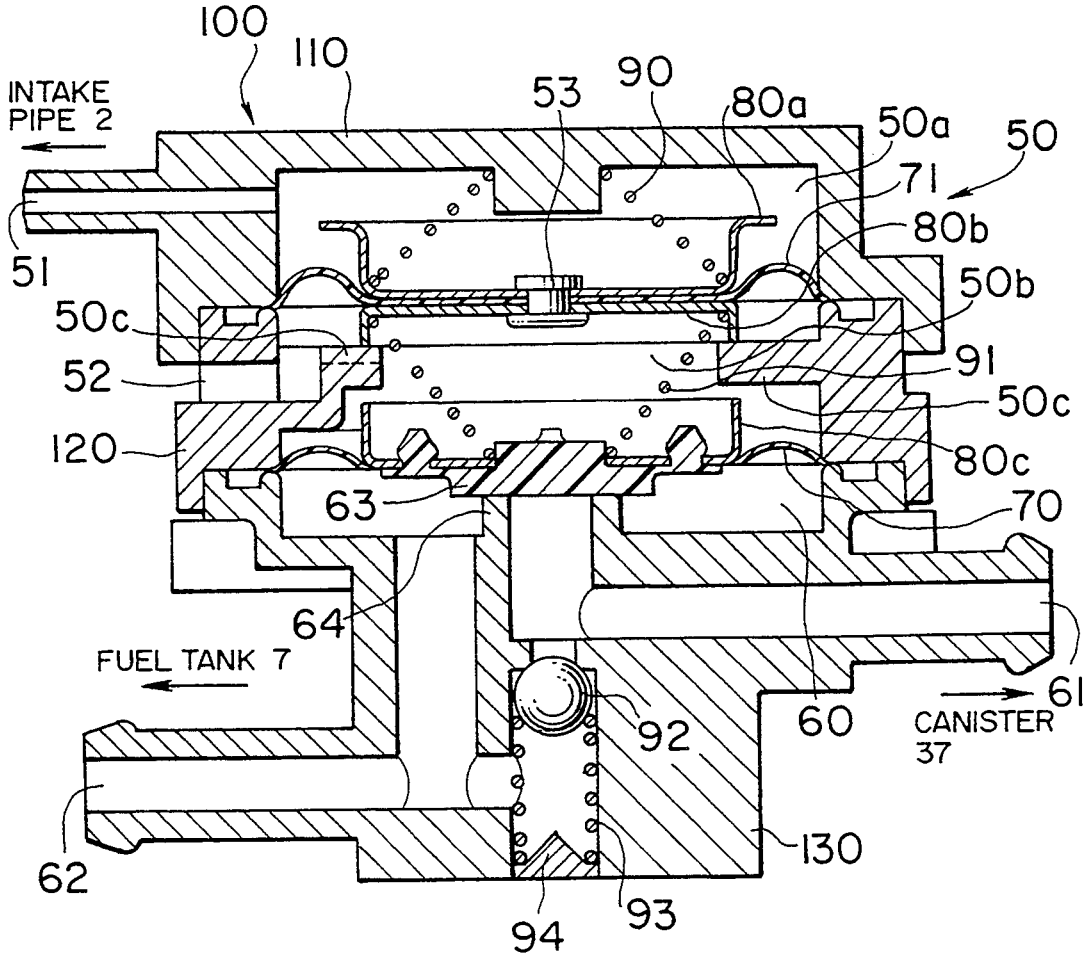
FIG. 2 is a cross-sectional view of a fuel tank pressure control valve of the invention.

The construction of the tank pressure control valve 100 will now be described with reference to FIG. 2 which is a cross-sectional view of the valve 100.

The interior of the control valve 100 is divided into an air chamber 50 and an evaporated fuel chamber 60 by a diaphragm 70 fixedly held at an outer peripheral portion thereof between a first housing 120 and a second housing 130. The air chamber 50 is divided into an intake chamber 50*a* and an atmosphere chamber 50*b* by a diaphragm 71 fixedly held at an outer peripheral portion thereof between a cover 110 and the first housing 120.

The cover 110 has an intake port 51 communicating the surge tank 35 of the intake pipe 2 with the intake chamber 50*a*. The first housing 120 has an atmosphere port 52 communicating the atmosphere chamber 50*b* with the atmosphere. Dish-like stoppers 80*a* and 80*b* are fixedly secured by a rivet 53 respectively to the opposite sides of the diaphragm 71 facing the intake chamber 50*a* and the atmosphere chamber 50*b*, respectively. A spring 90 is mounted between the stopper 80*a* and the cover 110. When a negative pressure in the intake pipe 2 acts on the intake chamber 50*a*, the spring 90 is compressed.

The second housing 130 has a purge port 61 and a tank port 62 which are communicated with the evaporated fuel chamber 60. The purge port 61 is communicated with the purge pipe 36 connected to the canister 37 while the tank port 62 is communicated with the purge pipe 36 connected to the fuel tank 7. An integral valve member 63 is formed at the central portion of the diaphragm 70. The valve member 63 moves into and out of contact with a valve seat 64 on the second housing 130 to interrupt and allow communication between the evaporated fuel chamber 60 and the purge port 61, which valve seat 64 is defined by one end of the purge port 61 open to the evaporated fuel chamber 60. A dish-like stopper 80*c* is fixedly secured to the side of the diaphragm 70 facing the atmosphere chamber 50*b*. A spring 91 is mounted between this stopper 80*c* and the stopper 80*b* secured to the diaphragm 71. The set load of this spring 91 is smaller than the set load of the spring 90. The valve member 63 can move upward until the stopper 80*c* is brought into engagement with a lower surface of a stepped portion 50*c* formed on the first housing 120.

Mounted at a lower portion of the second housing 130 is a ball valve which comprises a ball 92, a spring 93 and a spring seat 94. When the pressure within the fuel tank 7 reaches a predetermined negative pressure, the ball 92 moves downward against the bias of the spring 93 to communicate the purge port 61 with the tank port 62. In this ball valve, the spring 93 can be exchanged to vary a set load acting on the ball 92. With this arrangement, the negative pressure within the fuel tank 7, at which the ball valve is opened, is adjusted. Threads may be formed on an outer periphery of the spring seat 94 so that the height of the spring seat 94 relative to the second housing 130 can be adjusted by these threads. By doing so, the set load exerted on the ball 92 by the spring 93 can be adjusted, and therefore the negative pressure within the fuel tank 7, at which the ball valve is opened, can be adjusted.

In this embodiment, detection means is constituted mainly by the diaphragm 71, the spring 90 and the intake chamber 50*a*, and control (adjustment) means is constituted mainly by the spring 90, the spring 91, the valve member 63 and the diaphragm 70.

With this construction of the control valve 100, when an intake negative pressure acts on the intake chamber 50*a*, the diaphragm 71 moves upward against the bias of the spring 90 because of a pressure difference between this intake negative pressure and the atmospheric pressure within the atmosphere chamber 50*b* until the stopper 80*a* is brought into engagement with an inner surface of the cover 110. As a result, the spring 91 is axially expanded by an amount corresponding to an amount of upward movement of the stopper 80*a*, so that the set load acting on the diaphragm 70 is reduced.

When the intake negative pressure ceases to act on the intake chamber 50*a*, and so the pressure within the intake chamber 50*a* reaches the atmospheric pressure, the diaphragm 71 moves downward under the influence of the spring 90 until the stopper 80*b* is brought into engagement with the upper surface of the stepped portion 50*c* of the first housing 120. As a result, the spring 91 is axially contracted or becomes shorter than it is when the intake negative pressure acts on the intake chamber 50*a*, and therefore the set load acting on the diaphragm 70 becomes larger than it is when the intake negative pressure acts on the intake chamber 50*a*.

Therefore, the set load of the spring 91 acting on the diaphragm 70 is small in the operating condition of the engine 1, in which the intake negative pressure develops, and this set load becomes larger in the stopped condition of the engine 1 in which the intake negative pressure does not develop. Therefore, the pressure within the fuel tank 7 (which is communicated with the evaporated fuel chamber 60), at which the valve member 63 is opened, is set to a low level (as indicated by "pressure PI") in the operating condition of the engine 1, and is set to a high level (as indicated by "pressure P2") in the stopped condition of the engine 1.

The operation of the fuel tank pressure control apparatus of this embodiment will now be described.

Normally, the valve member 63 of the control valve 100 is closed, and when the fuel within the fuel tank 7 begins to evaporate, the pressure within the fuel tank 7 increases. Here, in the operating condition of the engine, when the pressure within the fuel tank 7 exceeds the pressure P1, the valve member 63 is opened. On the other hand, in the stopped condition of the engine 1, the pressure within the fuel tank 7 exceeds the pressure P2, the valve member 63 is opened. Therefore, in the operating condition of the engine 1, the pressure within the fuel tank 7 is maintained at the pressure P1 while in the stopped condition of the engine 1, the pressure within the fuel tank 7 is maintained at the pressure P2. The evaporated fuel passes through the purge port 61 and the purge pipe 36, and is adsorbed by the canister 37. Then, when an energizing signal is fed from the control circuit 44 to the purge valve 40, the purge valve 40 is opened, so that the evaporated fuel is fed into the intake pipe 2.

With respect to the pressure within the fuel tank 7, the pressure P2 is greater than the pressure P1, as described above. Therefore, in the operating condition of the engine 1, even if a leakage accident occurs between the fuel tank 7 and the control valve 100, the evaporated fuel is prevented from being discharged in a large amount to the ambient atmosphere, since the pressure within the fuel tank 7 is set to the lower pressure P1. Moreover, the fuel tank 7 is caused to communicate with the canister 37 at the predetermined pressure P1 in the operating condition of the engine 1, and therefore the evaporated fuel is prevented from being fed from the fuel tank 7 to the canister 37 at a pressure lower than the pressure P1. This eliminates a disadvantage that the canister 37 must be of a larger size in order to prevent the evaporated fuel from being discharged to the atmosphere via the atmosphere-opening port 38. Furthermore, when the fuel is supplied during the operation of the engine, it will not flow into the canister if the pressure does not exceeds the pressure P1. Therefore, at the time of supplying the fuel, the fuel is prevented from flowing from the fuel tank 7 into the canister 37, thereby preventing the adsorbent in the canister from being deteriorated.

The pressure within the fuel tank 7, at which the fuel tank 7 is caused to communicate with the canister in the stopped condition of the engine 1, is set to the higher pressure P2, as described above. Therefore, the evaporated fuel can not easily be produced in the fuel tank 7, and besides unless the tank pressure becomes greater than the pressure P2, the evaporated fuel will not flow into the canister 37, so that the evaporated fuel is prevented from being excessively supplied to the canister 37. Therefore, the amount of the evaporated fuel adsorbed by the canister 37 is reduced, and hence the canister 37 can be of a small or compact size.

Thus, the canister can be of a compact size, and besides the amount of leakage of the evaporated fuel into the atmosphere in the event of a leakage accident can be reduced.

When the temperature within the fuel tank 7 drops to liquify the evaporated fuel and so a negative pressure develops in the fuel tank 7, the ball valve 92 is opened to increase the pressure within the fuel tank 7. This prevents the fuel tank 7 from being deformed by the negative pressure developing in the fuel tank 7. Furthermore, by opening the ball valve 92, the evaporated fuel residing in the canister 37 can be caused to flow back into the fuel tank 7. Therefore, the amount of the evaporated fuel residing in the canister 37 is reduced, so that the canister 37 can be of a compact size.

Figure 3:
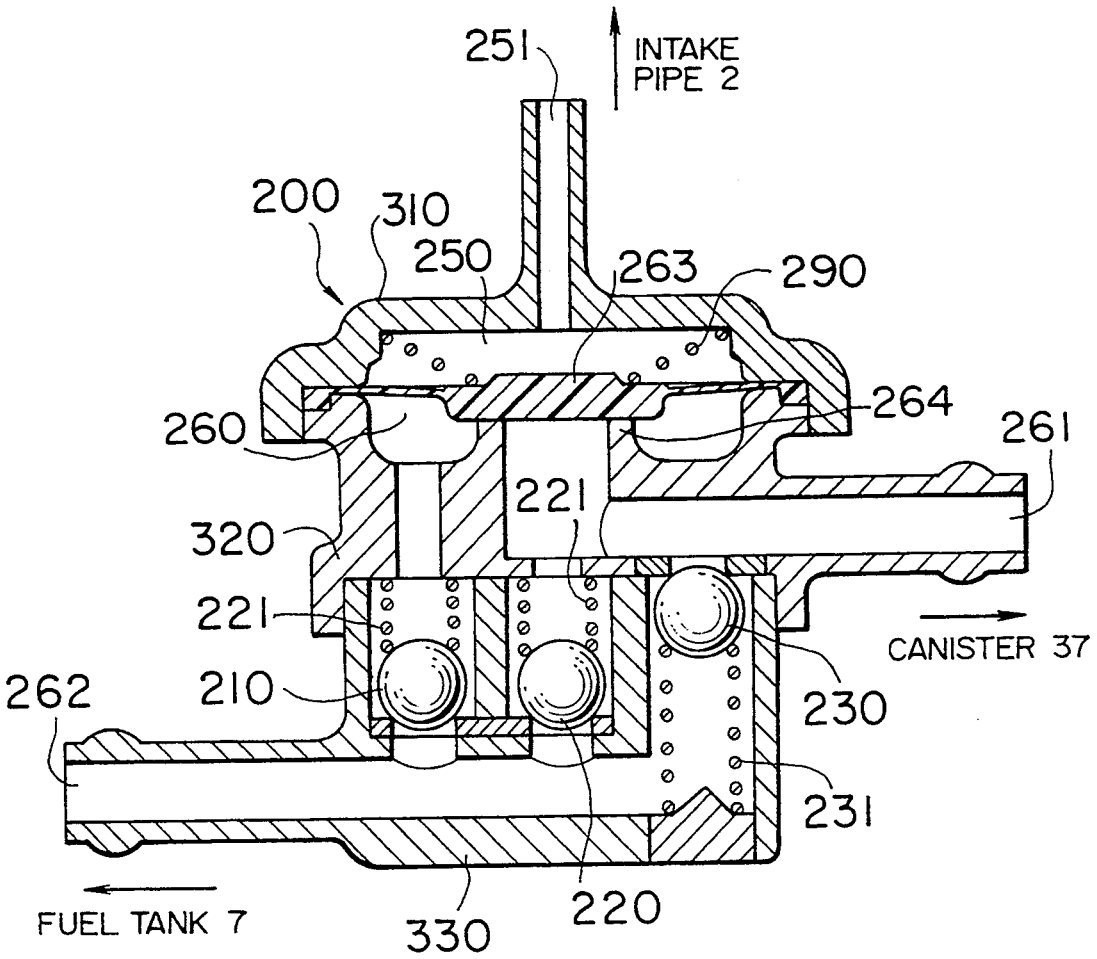
FIG. 3 is a cross-sectional view of a modified fuel tank pressure control valve of the invention.

Instead of the control valve 100, a control valve 200 shown in FIG. 3 may be used. The construction of the control valve 200 will now be described. The other portions than the control valve 200, which are associated with the engine, are the same as those of the above embodiment.

The interior of the control valve 200 is divided into an intake chamber 250 and an evaporated fuel chamber 260 by a diaphragm valve 263 fixedly held at an outer peripheral portion thereof between a cover 310 and a first housing 320. The cover 310 has an intake port 251 which communicates the intake chamber 250 with the intake pipe 2. A spring 290 is mounted within the intake chamber 250, and acts between the diaphragm valve 263 and the cover 310. The spring 290 is compressed when an intake negative pressure acts on the intake chamber 250 in the operating condition of the engine 1.

The first housing 320 has a purge port 261 which is communicated with the purge pipe 36 connected to the canister 37. An end portion of the purge port 261 opened to the evaporated fuel chamber 260 serves as a valve seat 264 for the diaphragm valve 263. The diaphragm valve 263 moves into and out of contact with the valve seat 264 to interrupt and allow communication between the evaporated fuel chamber 260 and the purge port 261.

A second housing 330 disposed beneath the first housing 320 has a tank port 262 communicated with the purge pipe 36 connected to the fuel tank 7. The tank port 262 can be communicated with each of the evaporated fuel chamber 260 and the purge port 261. Provided between the tank port 262 and the evaporated fuel chamber 260 is a first ball valve which comprises a first ball 210 and a spring 211. Provided between the tank port 262 and the purge port 261 are a second ball valve and a third ball valve. This second ball valve comprises a second ball 220 and a spring 221, and the third ball valve comprises a third ball 230 and a spring 231.

When the pressure within the fuel tank 7 exceeds the pressure P1, the first ball 210 of the first ball valve moves upward against the bias of the spring 211 to communicate the evaporated fuel chamber 260 with the tank port 262. When the pressure within the fuel tank 7 exceeds the pressure P2, the second ball 220 of the second ball valve moves upward against the bias of the spring 221 to communicate the purge port 261 with the tank port 262. When the pressure within the fuel tank 7 reaches a predetermined negative pressure, the third ball 230 of the third ball valve moves downward against the bias of the spring 231 to communicate the purge port 261 with the tank port 262.

In the control valve 200 of this embodiment, detection means is constituted mainly by the spring 290, the diaphragm valve 263 and the intake chamber 250, and a control means is constituted mainly by the first ball valve (which comprises the first ball 210 and the spring 211) and the second ball valve (which comprises the second ball 220 and the spring 221).

The operation of the control valve 200 of the above construction will now be described. In the operating condition of the engine 1, the diaphragm valve 263 is opened by an intake negative pressure produced. Then, when the pressure within the fuel tank 7 exceeds the pressure P1, the first ball valve is opened, so that the evaporated fuel passes through the evaporated fuel chamber 260 and the purge port 261 into the canister 37.

On the other hand, in the stopped condition of the engine 1, the intake negative pressure ceases to develop, and therefore the diaphragm valve 263 is closed under the influence of the spring 290. Therefore, even if the pressure within the fuel tank 7 exceeds the pressure P1 to open the first ball valve, the evaporated fuel can not flow into the purge port 261. When the pressure within the fuel tank 7 further increases to exceed the pressure P2, the second ball valve is opened, so that the evaporated fuel flows through the purge port 261 into the canister 37.

Thus, in the operating condition of the engine 1, the pressure within the fuel tank 7 can be kept to the lower pressure P1, and in the stopped condition of the engine 1, the pressure within the fuel tank can be kept to the higher pressure P2. Therefore, as in the preceding embodiment, the canister 37 can be of a compact size, and the amount of leakage of the evaporated fuel into the atmosphere in the event of a leakage accident can be reduced.

In the above embodiments, the pressure within the fuel tank is set by the spring and the diaphragm in accordance with the operating condition and the stopped condition of the engine; however, there may be provided a sensor for detecting the pressure within the fuel tank, in which case when the pressure within the fuel tank reaches a predetermined level, the sensor outputs a signal, and the control valve is opened and closed in response to this output signal.

In the fuel tank pressure control apparatuses of the present invention, in the operating condition of the engine, the pressure within the fuel tank is adjusted to the first predetermined pressure (lower pressure), so that the flow of the evaporated fuel into the atmosphere is suppressed in the event of a leakage accident. The fuel tank is brought into communication with the canister when this first predetermined pressure is reached, and therefore the amount of flow of the evaporated fuel from the fuel tank into the canister is suppressed.

In the stopped condition of the engine, the pressure within the fuel tank is adjusted to the second predetermined pressure (higher pressure), so that the evaporated fuel is prevented from excessively supplied to the canister. Therefore, the amount of production of the evaporated fuel, as well as the amount of adsorption of the evaporated fuel to the canister, is reduced, and therefore the canister can be of a compact size.

Thus, the canister can be of a compact size, and besides the amount of leakage of the evaporated fuel into the atmosphere in the event of a leakage accident is reduced.

What is claimed is:

1. Apparatus for controlling a pressure within a fuel tank, comprising:

detection means for determining whether an engine is in an operating condition or in a stopped condition;

means for adsorbing evaporated fuel produced within the fuel tank; and control means for adjusting pressures within the fuel tank, at which the fuel tank is caused to communicate with said evaporated fuel adsorbing means, to a first predetermined level when said detection means determines that the engine is in the operating condition, and to a second predetermined level when said detection means determines that the engine is in the stopped condition, said second predetermined level being higher than said first predetermined level, in which said evaporated fuel adsorbing means is connected to an intake pipe via a connection pipe, and a valve electrically operated for being opened and closed is provided in said connection pipe, in which said fuel tank and said evaporated fuel adsorbing means are connected to each other by a valve mechanism independent of said control means, said valve mechanism being opened when the pressure within the fuel tank decreases, in which said control means comprises a first spring and a second spring which is urged against said first spring, a valve member urged by said second spring, and a first diaphragm mounted on said valve member, and said detection means comprises a second diaphragm, said first spring urging said second diaphragm, and an intake chamber which is disposed on one side of said second diaphragm and receives said first spring therein.

2. Apparatus for controlling a pressure within a fuel tank, comprising:

detection means for determining whether an engine is in an operating condition or in a stopped condition;

means for adsorbing evaporated fuel produced within the fuel tank; and control means for adjusting pressures within the fuel tank, at which the fuel tank is caused to communicate with said evaporated fuel adsorbing means, to a first predetermined level when said detection means determines that the engine is in the operating condition, and to a second predetermined level when said detection means determines that the engine is in the stopped condition, said second predetermined level being higher than said first predetermined level, in which said evaporated fuel adsorbing means is connected to an intake pipe via a connection pipe, and a valve electrically operated for being opened and closed is provided in said connection pipe, in which said fuel tank and said evaporated fuel adsorbing means are connected to each other by a valve mechanism independent of said control means, said valve mechanism being opened when the pressure within the fuel tank decreases, in which said control means comprises a first ball valve and a second ball valve, and said detection means comprises a spring, a diaphragm valve urged by said spring, and an intake chamber which is disposed on one side of said diaphragm valve and receives said spring therein.

* * * * *